US008052476B2

(12) United States Patent
Zheng et al.

(10) Patent No.: US 8,052,476 B2
(45) Date of Patent: Nov. 8, 2011

(54) ELECTRICAL CONNECTOR WITH ADDITIONAL MATING PORT

(75) Inventors: Qi-Sheng Zheng, Kunshan (CN); Zhong-Hua Yao, Kunshan (CN); Jia-Yong He, Kunshan (CN); Fang-Hua Shu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 259 days.

(21) Appl. No.: 12/548,710

(22) Filed: Aug. 27, 2009

(65) Prior Publication Data

US 2010/0055987 A1 Mar. 4, 2010

(30) Foreign Application Priority Data

Aug. 27, 2008 (CN) ..... 2008 2 0041468
Aug. 31, 2008 (CN) ..... 2008 2 0041737

(51) Int. Cl.
*H01R 24/00* (2011.01)

(52) U.S. Cl. ..... 439/660

(58) Field of Classification Search ..... 439/660, 439/541.5, 607.23, 607.27, 607.35, 607.55, 439/701, 607.24, 607.53, 540.1, 607.01
See application file for complete search history.

(56) References Cited

U.S. PATENT DOCUMENTS

| | | | | |
|---|---|---|---|---|
| 6,334,793 | B1 | 1/2002 | Amoni et al. | |
| 6,540,563 | B1 * | 4/2003 | Hu et al. | 439/676 |
| 7,364,463 | B1 * | 4/2008 | Ju | 439/607.55 |
| 7,410,391 | B2 * | 8/2008 | Wan et al. | 439/607.01 |
| 7,611,380 | B2 * | 11/2009 | Yuan | 439/541.5 |
| 7,762,840 | B2 * | 7/2010 | Hamner et al. | 439/541.5 |
| 7,967,631 | B2 * | 6/2011 | Wang et al. | 439/541.5 |
| 2007/0049115 | A1 | 3/2007 | Igarashi et al. | |
| 2008/0176449 | A1 * | 7/2008 | Hu et al. | 439/607 |
| 2008/0293301 | A1 * | 11/2008 | Hamner et al. | 439/607 |

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

An electrical connector includes an insulative housing having a top face, a pair of side walls, a rear face and a first receiving cavity extending upwardly and through the top face; a contact module including a first tongue portion extending into the first receiving cavity, and a number of first contacts insert molded with the first tongue portion, the first contacts being disposed on a mounting surface of the first tongue portion and exposed to the first receiving cavity, the contact module being attached to the insulative housing; a second receiving cavity into which a second tongue portion extends, the first receiving cavity being essentially narrower than the second receiving cavity communicating with the first receiving cavity, the first and the second tongue portions being parallel to each other; a number of second contacts disposed on opposite first and second surfaces of the second tongue portion, the second contacts being elastic and protruding into the second receiving cavity.

14 Claims, 11 Drawing Sheets

ELECTRICAL CONNECTOR WITH ADDITIONAL MATING PORT

BACKGROUND OF THE INVENTION

1. Field of the Invention

The present invention relates to electrical connectors such as disclosed in U.S. Pat. No. 7,467,977, which is more particularly related to electrical connectors with additional mating ports for mating with corresponding connectors.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient.

As discussed above, with limited data transmission speed of the USB 2.0 connectors, there is a need to design electrical connectors with additional mating ports for high-speed signal transmission.

SUMMARY OF THE INVENTION

According one aspect of the present invention, an electrical connector, comprising: an insulative housing having a top face, a pair of side walls, a rear face and a first receiving cavity extending upwardly and through the top face; a contact module including a first tongue portion extending into the first receiving cavity, and a plurality of first contacts insert molded with the first tongue portion, the first contacts being disposed on a mounting surface of the first tongue portion and exposed to the first receiving cavity, the contact module being attached to the insulative housing; a second receiving cavity into which a second tongue portion extends, the first receiving cavity being essentially narrower than the second receiving cavity communicating with the first receiving cavity, the first and the second tongue portions being parallel to each other; a plurality of second contacts disposed on opposite first and second surfaces of the second tongue portion, the second contacts being elastic and protruding into the second receiving cavity.

According to another aspect of the present invention, an electrical connector, comprising: an insulative housing having a top face, a pair of side walls, a rear face and a first receiving cavity extending upwardly and through both the top face and the rear face; a contact module including a first tongue portion extending into the first receiving cavity, and a plurality of first contacts extending through the first tongue portion, the first contacts being exposed to the first receiving cavity, the contact module being attached to the insulative housing along a rear-to-front direction; a second receiving cavity into which a second tongue portion extends, the first receiving cavity being essentially narrower than the second receiving cavity communicating with the first receiving cavity, the first and the second tongue portions being parallel to each other; a plurality of second contacts disposed on opposite first and second surfaces of the second tongue portion, the second contacts being elastic and protruding into the second receiving cavity, the second receiving cavity, the second contacts and the second tongue portion are compatible with Standard-B USB 2.0 plug.

Other objects, advantages and novel features of the present invention will become more apparent from the following detailed description of the present embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
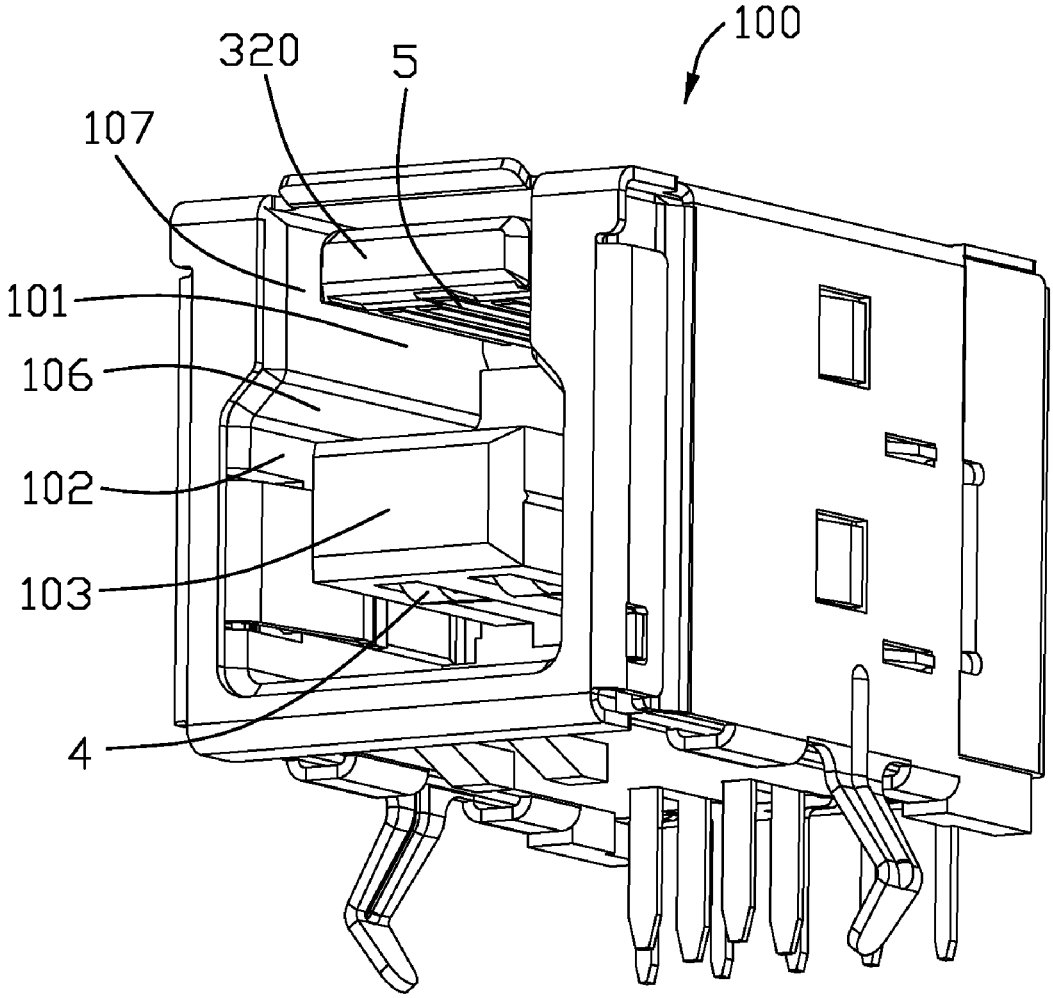
FIG. 1 is a perspective view of an electrical connector according to a preferred embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB 2.0 connector, receptacle, plug, and signaling all refer to the USB architecture described within the Universal Serial Bus Specification, 2.0 Final Draft Revision, Copyright December, 2002, which is hereby incorporated by reference herein.

Figure 2:
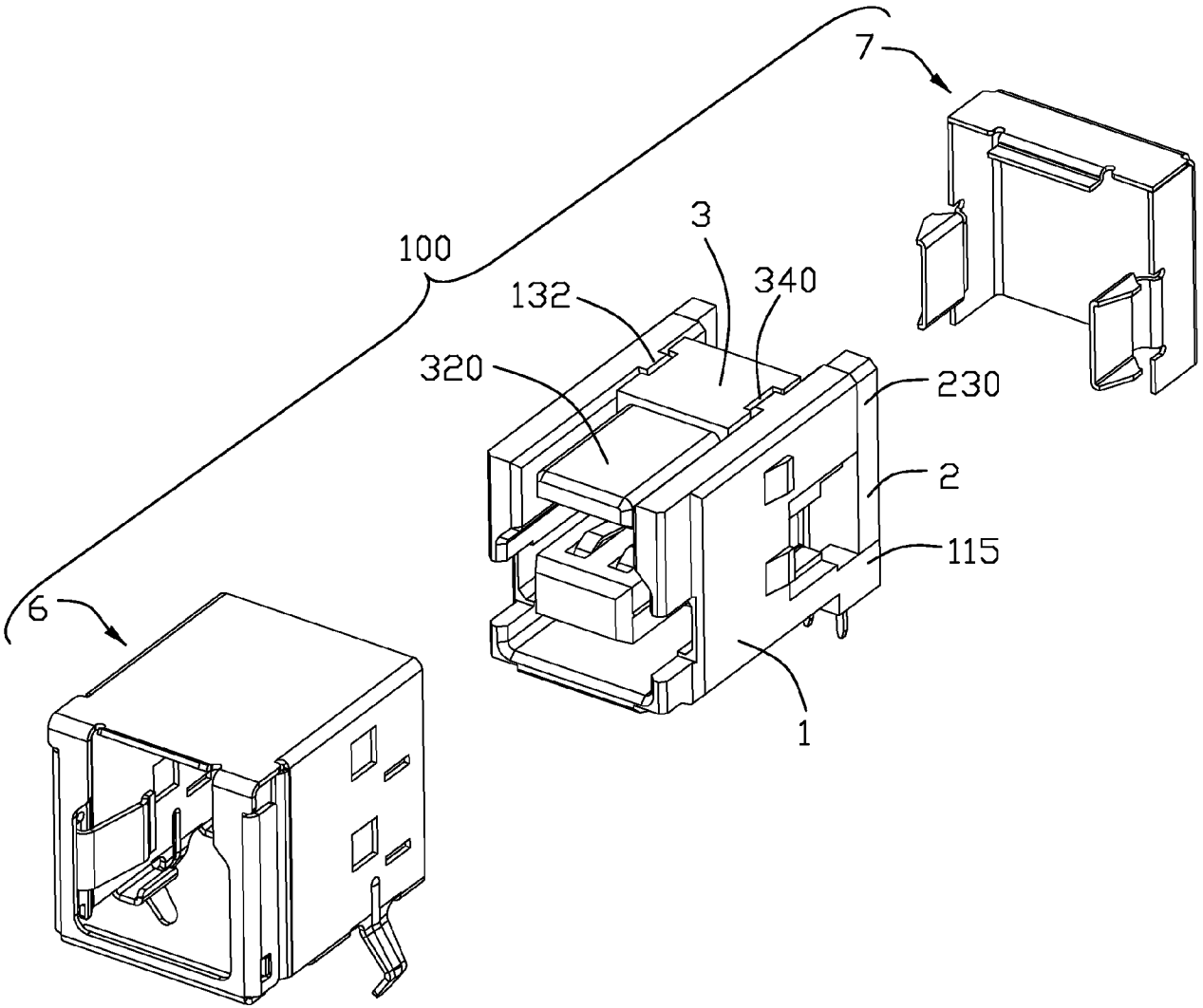
FIG. 2 is a partly exploded perspective view of the electrical connector.
Figure 3:
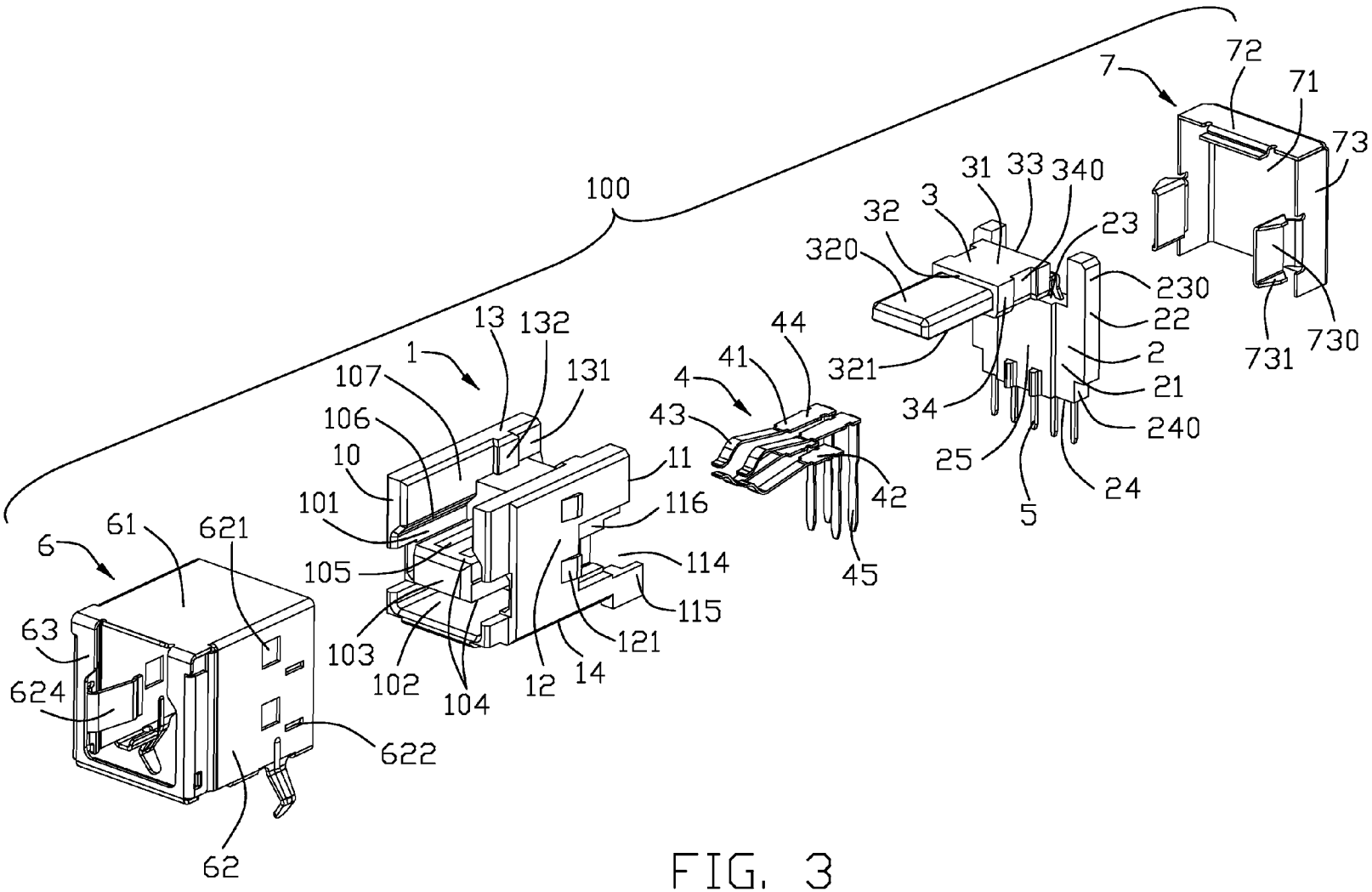
FIG. 3 is an exploded view of the electrical connector.
Figure 4:
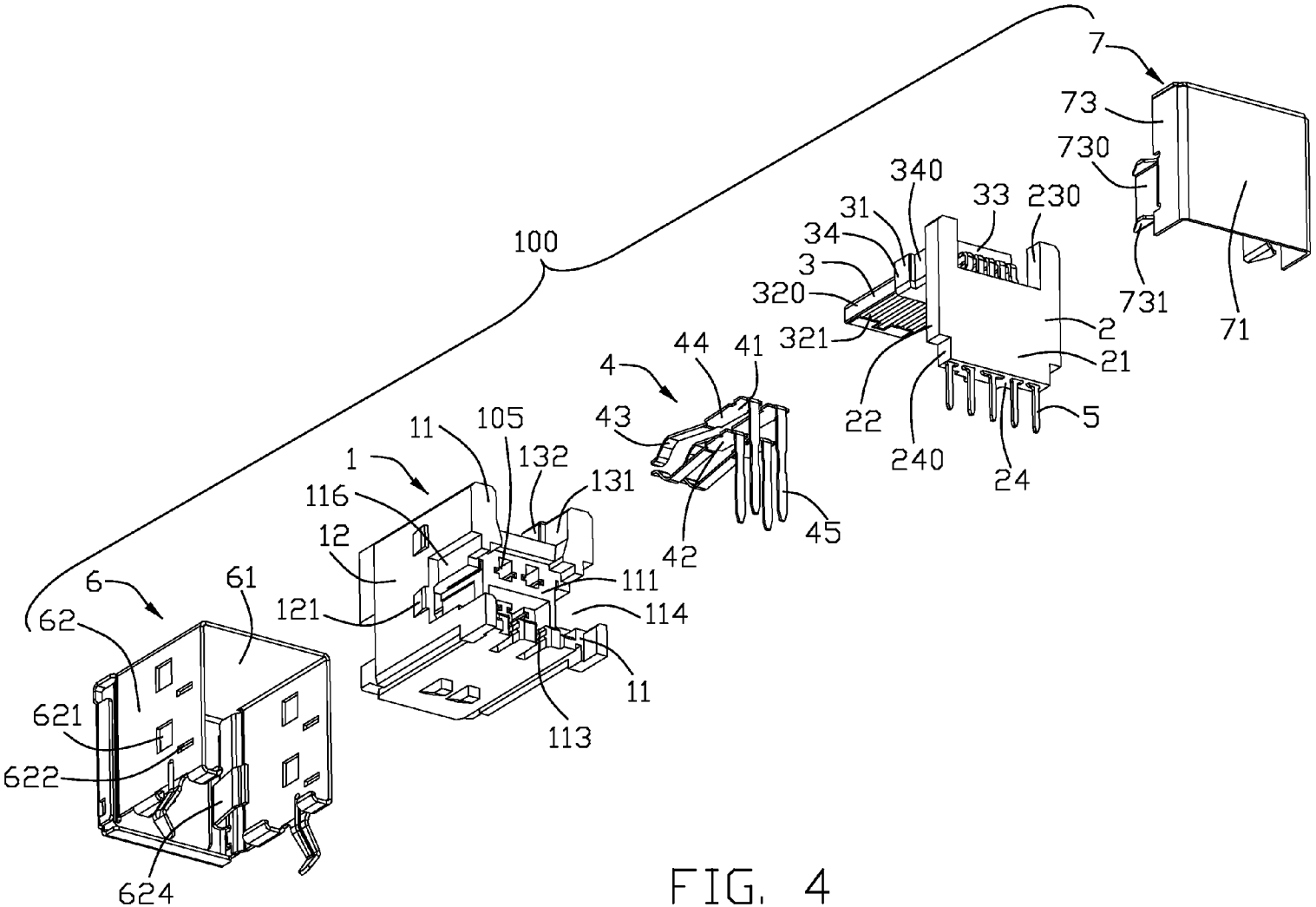
FIG. 4 is a view similar to FIG. 3, while taken from a different aspect.
Figure 5:
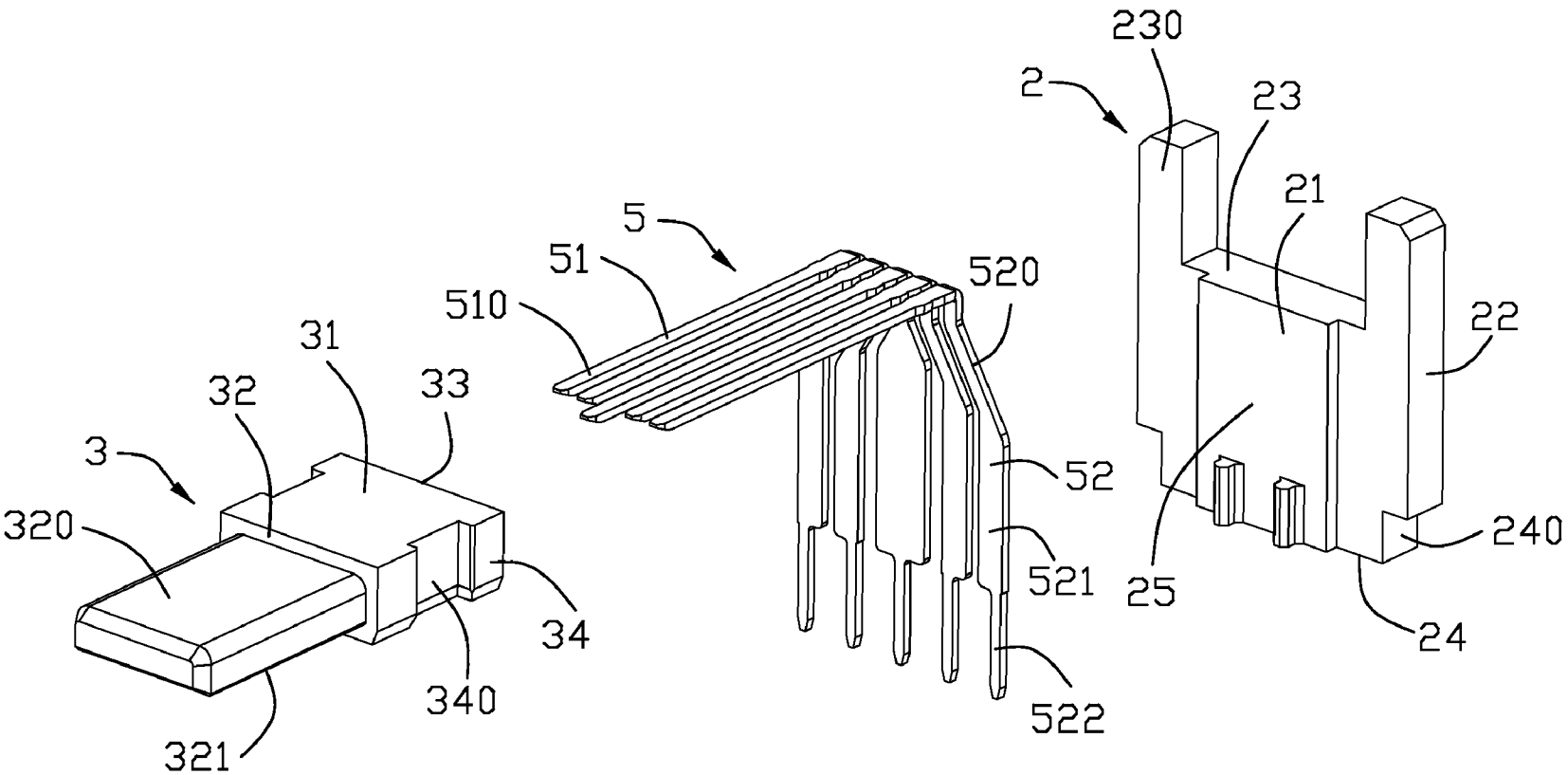
FIG. 5 is an exploded view of a contact module of the electrical connector shown in FIG. 1.

Referring to FIGS. 1-5, an electrical connector of the preferred embodiment is an USB receptacle 100 to mating with an standard B-type USB 2.0 plug or a second plug which is different from the standard B-type USB 2.0 plug. The electrical receptacle 100 is mounted on a Printed Circuit Board (PCB) and includes an insulative housing 1, a contact module attached to the insulative housing 1, a plurality of second contacts 4 retained in the insulative housing 1, and a shell enclosing the insulative housing 1 for EMI protection.

Referring to FIGS. 1-4, the insulative housing 1 includes a front face 10, a receiving cavity 101 recessed rearward from the front face 10, a rear face 11, a pair of side walls 12, a top face 13, a mounting face 14 opposite to the top face 13 and a base portion connecting with inner sides of the side walls 12. A pair of protrusions 121 project outwardly to lock with the shell. The receiving cavity 101 defines a first receiving cavity 107 with the contact module extending thereinto, and a second receiving cavity 102 with a second tongue portion 103 extending thereinto. The first and the second receiving cavities 107, 102 communicate with each other, the second receiving cavity 102 is much larger than the first receiving cavity 107. The second tongue portion 103 is formed integrally with the insulative housing 1 and extends forwardly from the base portion.

The width of the second receiving cavity 102 is larger than the width of the first receiving cavity 107. The height of the second receiving cavity 102 is larger than the height of the first receiving cavity 107. The first receiving cavity 107 is substantially rectangular shaped. The insulative housing 1 has a pair of chamfered portions 106 on an upper left corner and an upper right corner of the second receiving cavity 102, respectively. The chamfered portions 106 act as keys for regulating the insertion orientation of the second plug or the standard B-type USB 2.0 plug. In the preferred embodiment of the present invention, the first and the second tongue portions 320, 103 are stacked and spaced from each other in a vertical direction. The first tongue portion 320 is parallel to second tongue portion 103.

The contact module includes an insulative plate and a plurality of first contacts 5 insert molded with the insulative plate, the insulative plate has a lateral plate 3 and a vertical plate 2. The lateral plate 3 defines a main portion 31 and a first tongue portion 320 extending forwardly from a front face 32 of the main portion 31. The first tongue portion 320 includes a mounting surface 321 on which the first contacts 5 is located. The second tongue portion 103 is much thicker than the first tongue portion 320 along a height direction of the insulative housing 1. The second tongue portion 103 includes opposite first and second surfaces 104 on upper and lower sides thereof. The first and the second surfaces 104 each defines a pair of passageways 105, respectively, for receiving the second contacts 4. The mounting surface 321 is a lower surface of the first tongue portion 320. The mounting surface 321 is much closer to the first surface than to the second surface. That is to say, the mounting surface 321 directly faces the first surface 104.

The insulative housing 1 is further formed with a rear receiving room 131 to accommodate the contact module, the first receiving cavity 107 extends rearward through the rear face 11 of the insulative housing to communicate with the rear receiving room 131. A pair of resisting tabs 132 extend inwardly from inner sides of the side walls 12, the main portion 31 is provided with a pair of opposite cutouts 340 on a middle portion thereof to lock with the resisting tabs 132 respectively. The vertical plate 2 is retained in the rear receiving room 131.

The first contacts 5 of the preferred embodiment are non-elastic. Each first contact 5 comprises a plate-shaped contact portion 51 insert molded with the lateral plate 3, a bending portion 52 insert molded with the vertical plate 2, and a tail portion 522 on a distal end of the bending portion 52 to extend downwardly through the vertical plate 2. The contact portions 51 are exposed to the first receiving cavity 107 for mating with the second plug. The first contacts 5 of the preferred embodiment includes a middle grounding contact and two pairs of first and second signal contacts respectively disposed on a left side and a right side of the grounding contact respectively. The contact portion of the grounding contact is located on the mounting surface 321 of the first tongue portion 320 and is longer than that of the first or the second signal contacts so that the front end of the grounding contact is much closer to a free end of the first tongue portion 320. While insertion of a corresponding plug, the plug contacts with the contact portion of the grounding contact firstly and then contacts with the first and second signal contacts for better grounding protection.

The second contacts 4 of the preferred embodiment are elastic. Each second contact 4 comprises a convex shape elastic contact section 43, a retaining section 44 and a tail section 45 perpendicular to the retaining section 44. The contact sections 43 are located on the passageways 105 of the second tongue portion 103 and extend beyond the first and the second surfaces 104 to protrude into the second receiving cavity 102. The second contacts 4 include two contacts 43 disposed on the first surface of the second tongue portion 103, and two contacts 42 disposed on the second surface of the second tongue portion 103. The tail sections 45 are retained in through holes 113 on a bottom wall of the insulative housing 1 and extend downward beyond the insulative housing 1.

The electrical receptacle 100 includes a lower port compatible with the existing standard B-type USB 2.0 plug and an additional upper port for transmitting high-speed signals in order to improve the transmission speed. The upper and the lower ports are simultaneously combined to receive the second plug. It is obvious that the overall height of the electrical connector 100 is much larger than that of the standard B-type USB 2.0 receptacle because of the additional upper port.

The shell includes a front shell 6 enclosing the insulative housing 1, a rear shell 7 attached to the front shell 6 and a rear side of the insulative housing 1. The front shell 6 is stamped from a unitary one-piece metal sheet to have a top wall 61, a pair of side walls 62 and a pair of front walls 63 bending inwardly from front ends of the side walls 62. Each side wall 62 includes an engaging arm 624 extending into the second receiving cavity 102 to abut against the plug. Each side wall 62 further includes a plurality of locking holes 621 to latch with the protrusions 121 of the insulative housing 1, and a plurality of slits 622 to retain flexible latches 731 formed on the rear shell 7. The top wall 61 encloses the first receiving cavity 107, the first tongue portion 320 is located between and the top wall 61 and the second tongue portion 103, the first tongue portion 320 is parallel to both the top wall 61 and the second tongue portion 103. The vertical plate 2 is sandwiched between the rear face 11 of the insulative housing 1 and the rear metal shell 7.

When the contact module is assembled onto the insulative housing 1 along an upper-to-lower direction, the vertical plate 2 abuts against the rear face 11 and straddles on a pair of posts 115 on a bottom wall of the insulative housing 1, the vertical plate 2 includes a lower portion 240 on a lower end thereof to be sandwiched between the posts 115. The cutouts 340 of the lateral plate 3 lock with the resisting tabs 132 respectively to prevent the lateral plate 3 from moving along a front-to-rear direction. The main portion 31 of lateral plate 3 is sandwiched between side walls 12 of the insulative housing 1 along a lateral direction thereof. The main portion 31 is fixed between the insulative housing 1 and the top wall 61 of the front shell 6 along a height direction thereof.

Figure 6:
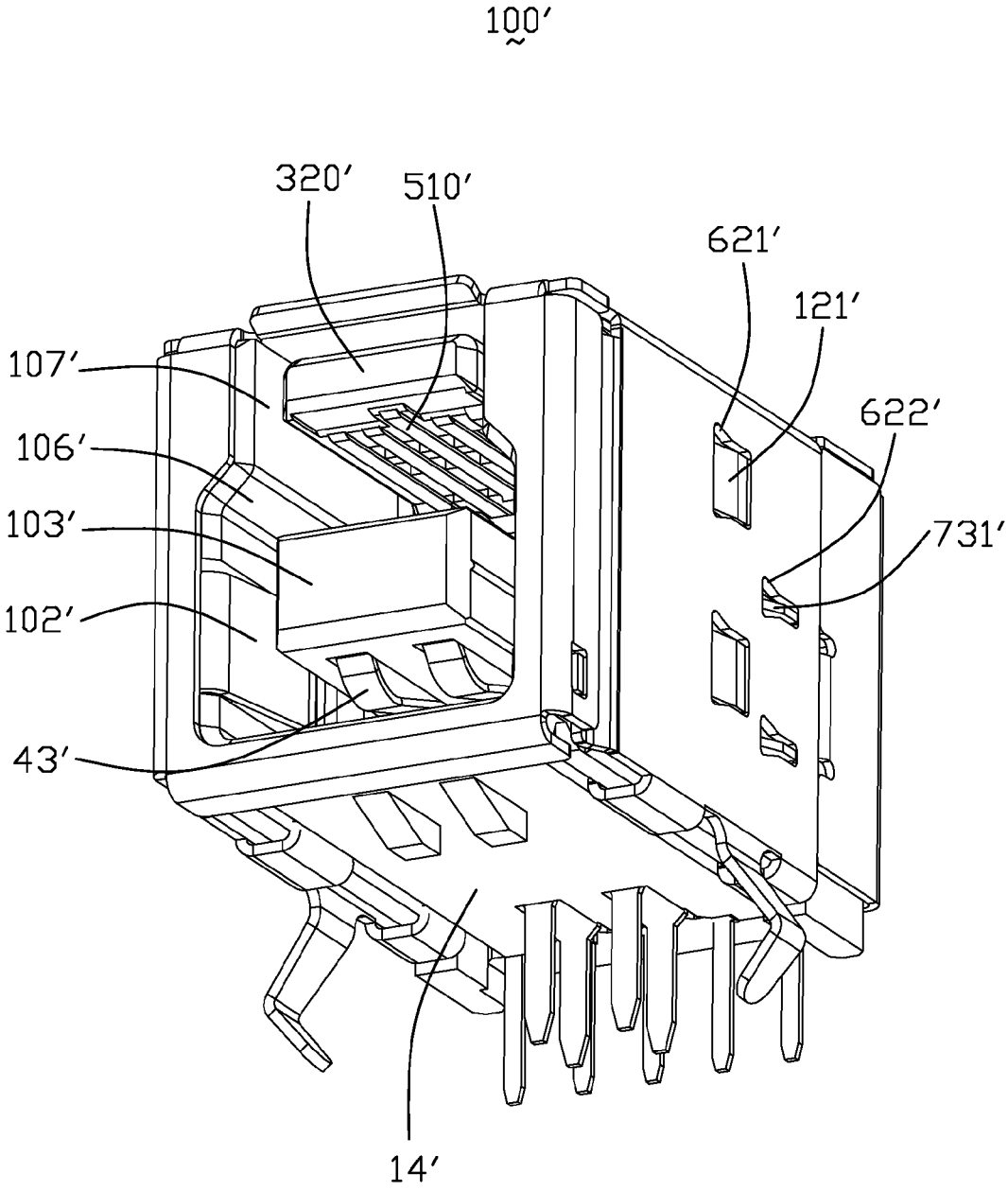
FIG. 6 is a perspective view of an electrical connector according to a second embodiment of the present invention.
Figure 7:
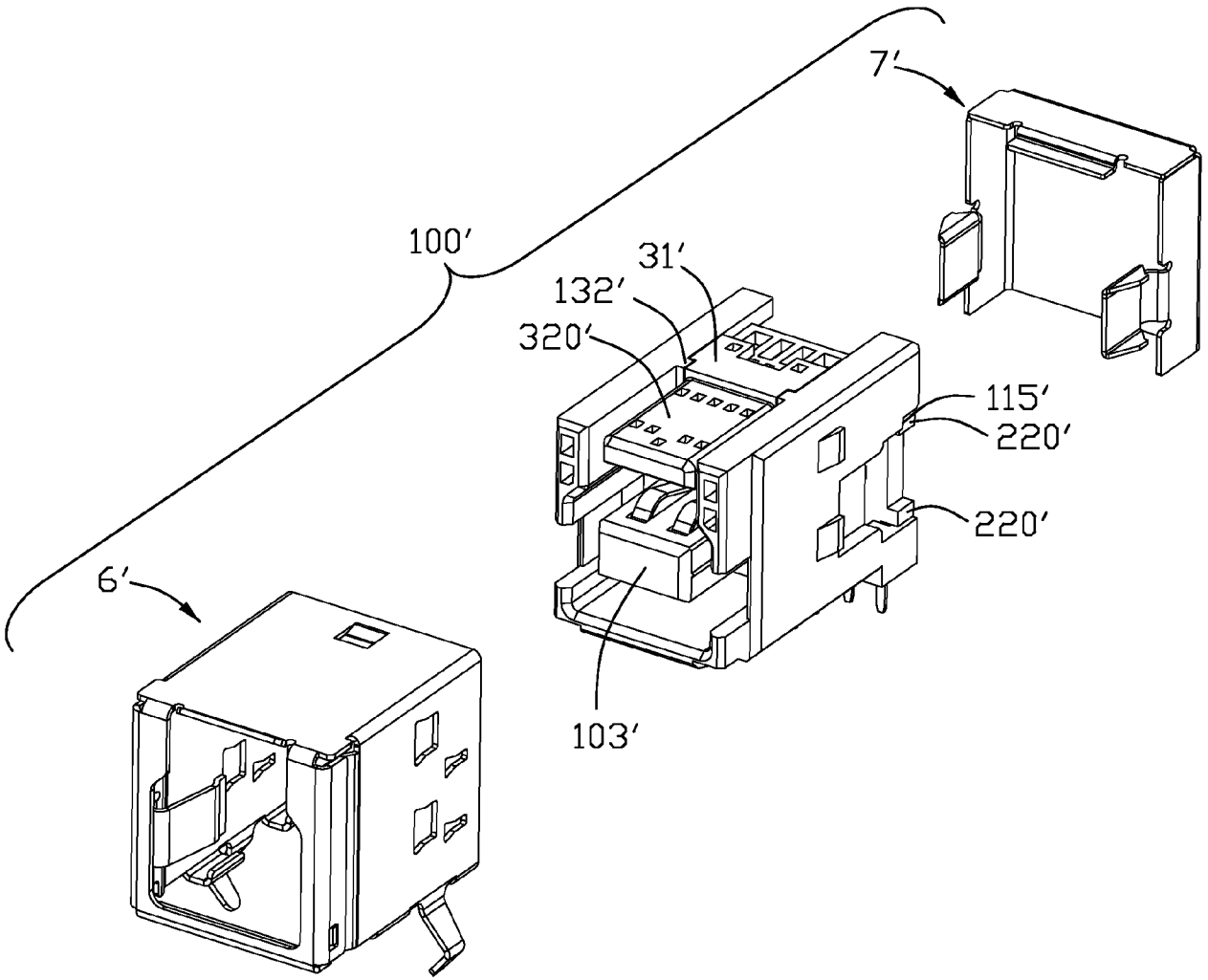
FIG. 7 is a partly exploded perspective view of the electrical connector shown in FIG. 6.
Figure 8:
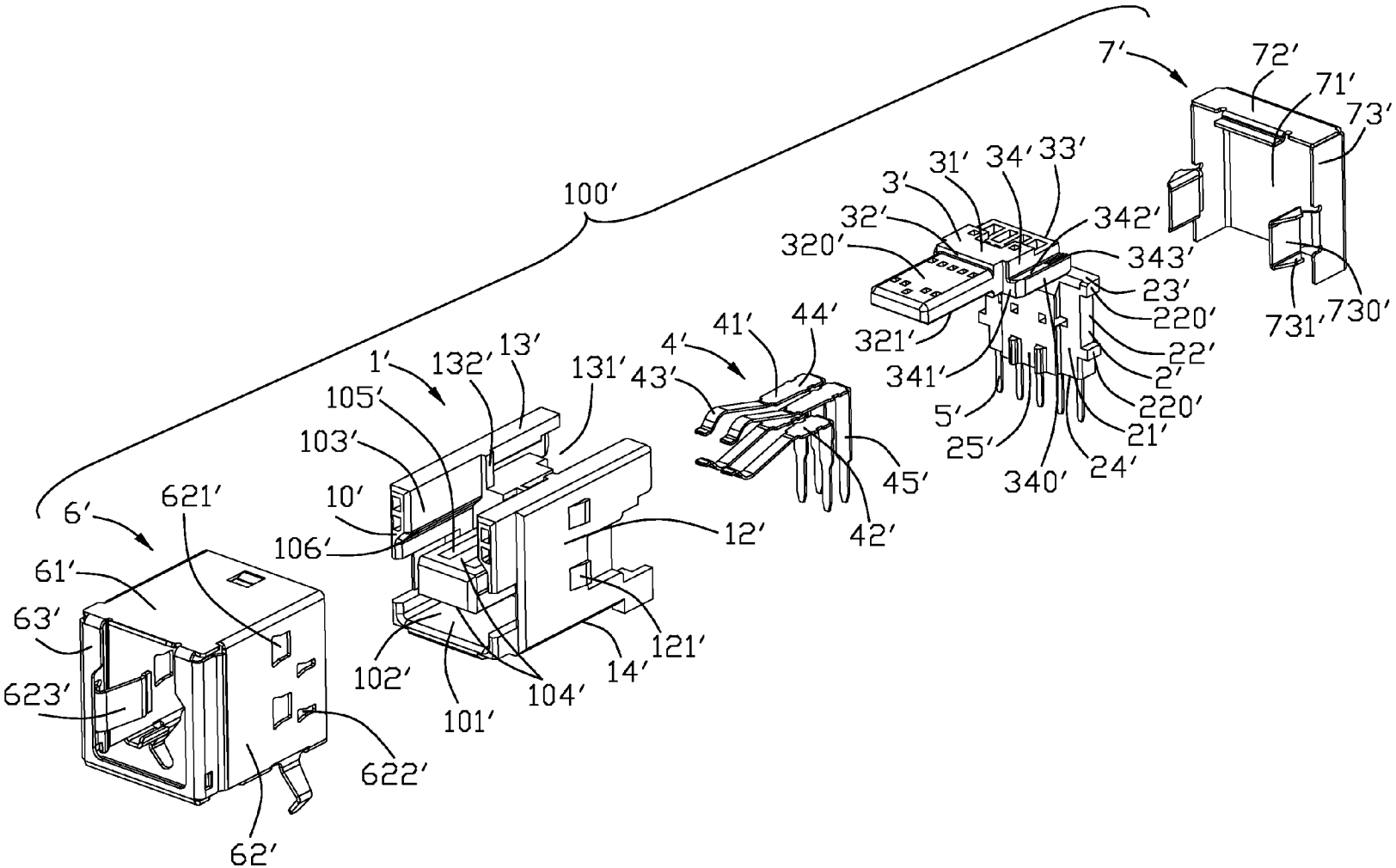
FIG. 8 is an exploded perspective view of the electrical connector shown in FIG. 6.
Figure 9:
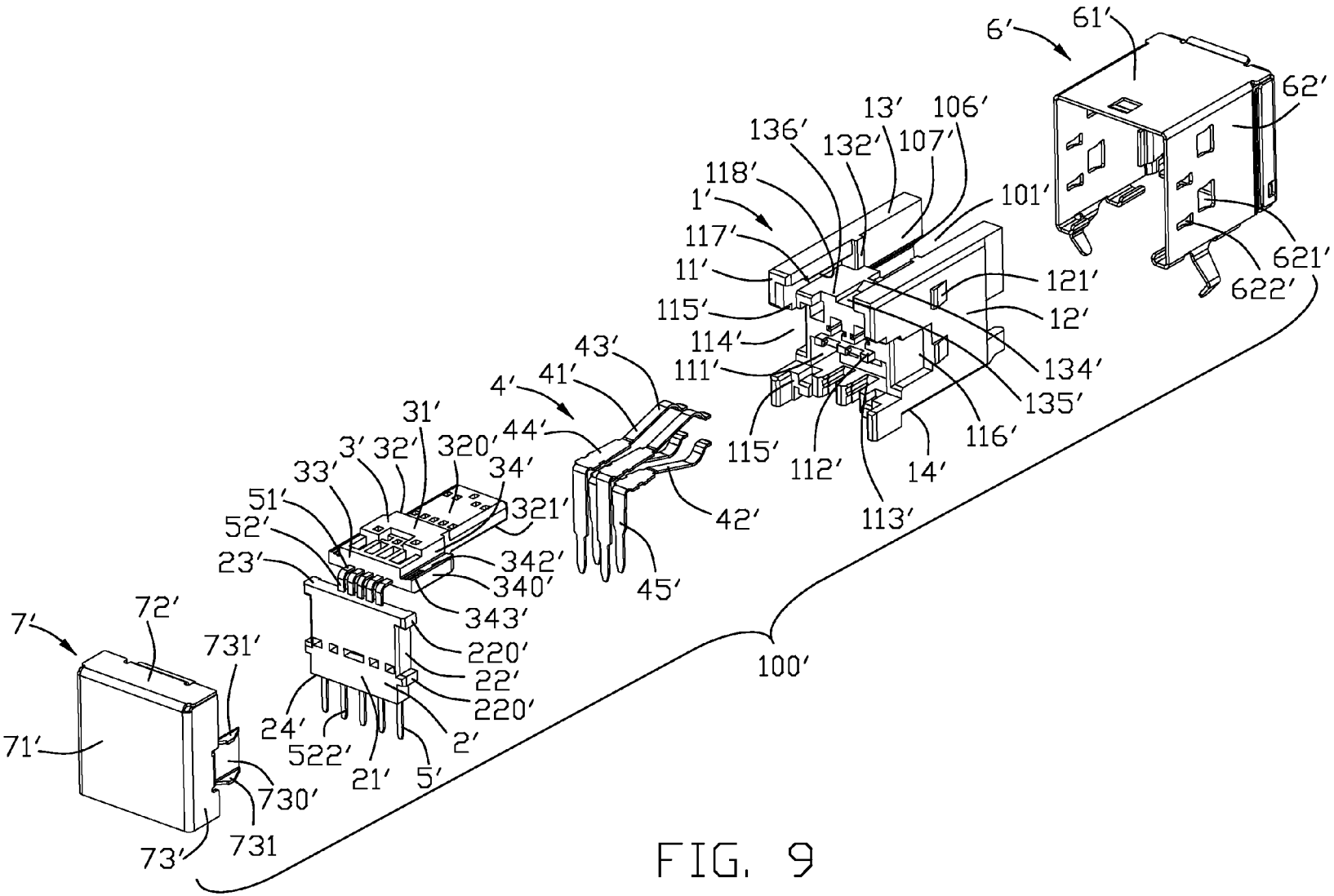
FIG. 9 is a view similar to FIG. 8, while taken from a different aspect.
Figure 10:
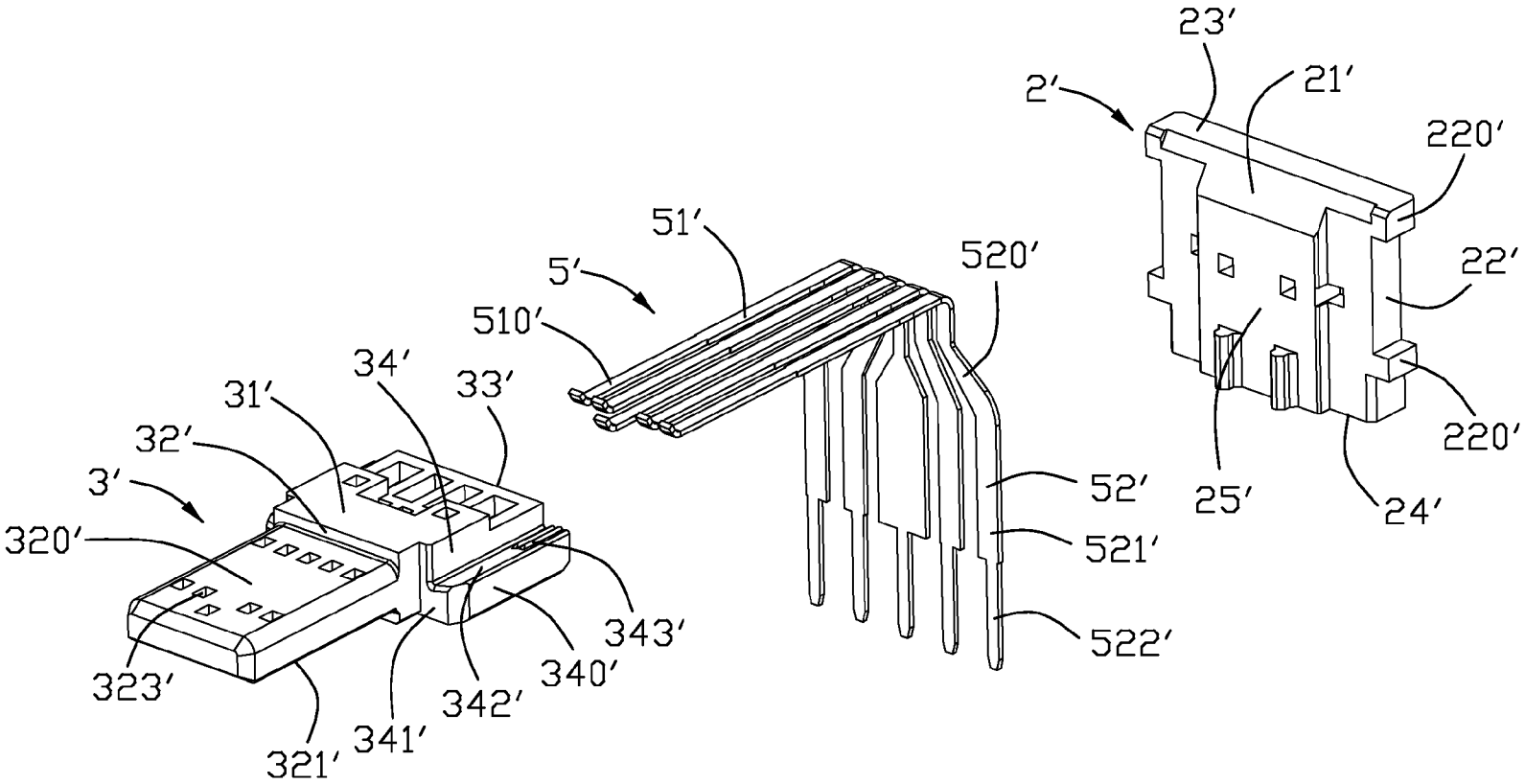
FIG. 10 is an exploded view of a contact module of the electrical connector shown in FIG. 6.
Figure 11:
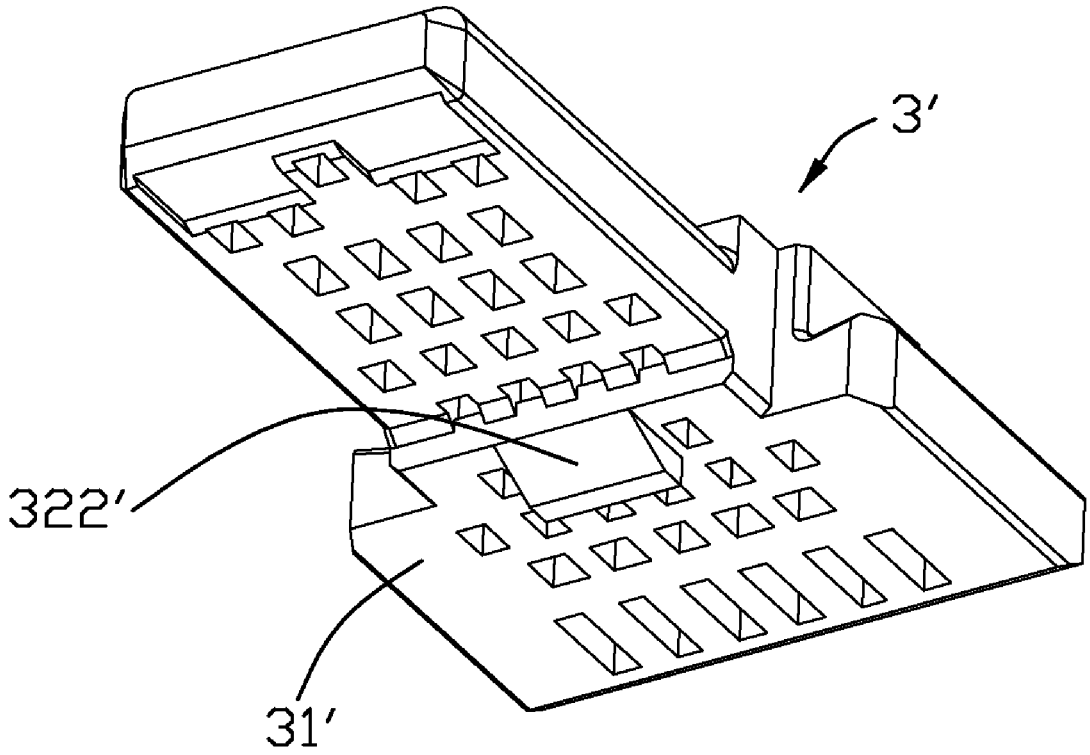
FIG. 11 is a perspective view of a lateral plate of the electrical connector shown in FIG. 6.

Referring to FIGS. 6-10, a second embodiment of the electrical connector 100' is similar to the first embodiment shown in FIGS. 1-5, and differs in that a pair of retaining slots 117' are provided on inner sides of the side walls 12' on the insulative housing 1', the main portion 31' of the lateral plate 3' defines a pair of retaining plates 340' which are fixed in the retaining slots 117' respectively. The side wall 12' of the insulative housing 1' is provided with fixing slot 114' on a rear side thereof, the vertical plate 2' is formed with lateral tab 220' retained in the fixing slot 114'. A guiding slot 135' is formed on an upper portion of the base portion 136' of the insulative housing 1', a resisting rib 134' is provided in the guiding slot 135'. While the contact module is assembled onto the insulative housing 1' along a rear-to-front direction, the front end of the retaining plates 340' abuts against the resisting tabs 132', the resisting rib 134' abut against a projection 322' formed on a lower face of the main portion 31', the lateral plate 3' is restricted along a front-to-rear direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing having a top face, a pair of side walls, a rear face and a first receiving cavity extending upwardly and through the top face;

a contact module including a first tongue portion extending into the first receiving cavity, and a plurality of first contacts insert molded with the first tongue portion, the first contacts being disposed on a mounting surface of the first tongue portion and exposed to the first receiving cavity, the contact module being attached to the insulative housing;

a second receiving cavity into which a second tongue portion extends, the first receiving cavity being essentially narrower than the second receiving cavity communicating with the first receiving cavity, the first and the second tongue portions being parallel to each other;

a plurality of second contacts disposed on opposite first and second surfaces of the second tongue portion, the second contacts being elastic and protruding into the second receiving cavity; wherein the insulative housing defines a base portion from which the second tongue portion extend forwardly, the contact module includes a lateral plate having a main portion from which the first tongue portion extend forwardly, the main portion is supported by the base portion.

2. The electrical connector as claimed in claim 1, further comprising a metal shell attached to the insulative housing, the metal shell defines a top wall to enclose the first receiving cavity, the first tongue portion is located between and the top wall and the second tongue portion, the first tongue portion is parallel to both the top wall and the second tongue portion.

3. The electrical connector as claimed in claim 1, wherein a cutout is formed on the lateral plate, the side wall of the insulative housing defines a resisting tab being retained in the cutout to prevent the lateral plate from moving along a front-to-rear direction.

4. The electrical connector as claimed in claim 1, wherein the first receiving cavity extend rearward through the rear face of the insulative housing, the side walls of the insulative housing define a pair of retaining slots on inner sides thereof, the retaining slots communicates with the first receiving cavity, the main portion of the lateral plate defines a pair of retaining plates which are fixed in the retaining slots respectively.

5. The electrical connector as claimed in claim 1, wherein the base portion of the insulative housing has a guiding slot on a top side thereof, a resisting rib is provided in the guiding slot, a projection is formed on a lower face of the main portion, the projection is inserted into the guiding slot along a rear-to-front direction to be locked by the resisting rib.

6. The electrical connector as claimed in claim 1, further comprising a rear metal shell attached to a rear side of the insulative housing, the contact module includes a vertical plate insert molded with the first contacts, the vertical plate is sandwiched between the rear face of the insulative housing and the rear metal shell.

7. The electrical connector as claimed in claim 1, wherein the mounting surface is much closer to the first surface of the second tongue portion than to the second surface of the second tongue portion, the mounting surface directly facing the first surface of the second tongue portion, the first contacts being plate-shaped and non-elastic.

8. The electrical connector as claimed in claim 1, wherein the first tongue portion is located above the second tongue portion, the mounting surface being a lower surface of the first tongue portion, the first and the second surfaces being opposite upper and lower surfaces of the second tongue portion, respectively.

9. The electrical connector as claimed in claim 1, wherein the second contacts include two contacts disposed on the first surface of the second tongue portion, and two contacts disposed on the second surface of the second tongue portion, the first contacts comprise a middle grounding contact and two pairs of signal contacts disposed on lateral sides of the grounding contact, the second receiving cavity is of corresponding shape to accommodate a standard B-type USB 2.0 plug, the insulative housing comprises at least one chamfered portion on top of the second receiving cavity, the second receiving cavity has a height larger than that of the first receiving cavity, the first and the second receiving cavities being combined to receive another electrical plug.

10. An electrical connector, comprising:

an insulative housing having a top face, a pair of side walls, a rear face and a first receiving cavity extending upwardly and through both the top face and the rear face;

a contact module including a first tongue portion extending into the first receiving cavity, and a plurality of first contacts extending through the first tongue portion, the first contacts being exposed to the first receiving cavity, the contact module being attached to the insulative housing along a rear-to-front direction;

a second receiving cavity into which a second tongue portion extends, the first receiving cavity being essentially narrower than the second receiving cavity communicating with the first receiving cavity, the first and the second tongue portions being parallel to each other;

a plurality of second contacts disposed on opposite first and second surfaces of the second tongue portion, the second contacts being elastic and protruding into the second receiving cavity, the second receiving cavity, the second contacts and the second tongue portion are compatible with Standard-B USB 2.0 plug; further comprising a metal shell attached to the insulative housing, the metal shell defines a top wall to enclose the first receiving cavity, the first tongue portion is located between the top wall and the second tongue portion, the first tongue portion is parallel to both the top wall and the second tongue portion, the insulative housing defines a base portion from which the second tongue portion extend forwardly, the contact module includes a lateral plate having a main portion from which the first tongue portion extend forwardly, the main portion is supported by the base portion.

11. The electrical connector as claimed in claim 10, wherein a cutout is formed on the lateral plate, the side wall of the insulative housing defines a resisting tab being retained in the cutout to prevent the lateral plate from moving along a front-to-rear direction.

12. The electrical connector as claimed in claim 10, wherein the side walls of the insulative housing defines a pair of retaining slots on inner side thereof, the retaining slots communicates with the first receiving cavity, the main portion of the lateral plate defines a pair of retaining plates which are fixed in the retaining slots respectively, the base portion of the insulative housing has a guiding slot on a top side thereof, a resisting rib is provided in the guiding slot, a projection is formed on a lower face of the main portion, the projection is inserted into the guiding slot along a rear-to-front direction to be locked by the resisting rib.

13. The electrical connector as claimed in claim 10, further comprising a rear metal shell attached to a rear side of the insulative housing, the contact module includes a vertical plate insert molded with the first contacts, the vertical plate is sandwiched between the rear face of the insulative housing and the rear metal shell.

14. The electrical connector as claimed in claim 10, wherein the mounting surface directly facing the first surface of the second tongue portion, the first contacts being plate-shaped and disposed on the mounting face, the first tongue portion is located above the second tongue portion, the mounting surface being a lower surface of the first tongue portion, the first and the second surfaces being opposite upper and lower surfaces of the second tongue portion, respectively, the first contacts comprise a middle grounding contact and two pairs of signal contacts disposed on opposite sides of the grounding contact, the second receiving cavity is much higher than the first receiving cavity, the first and the second receiving cavities being combined to receive another electrical plug.

* * * * *